US005527191A

United States Patent [19]

Bevis et al.

[11] Patent Number: 5,527,191

[45] Date of Patent: Jun. 18, 1996

[54] CONNECTOR FOR USE IN CABLE SPLICES

[75] Inventors: Arthur Bevis, Bramalea; Rickey Butler, Islington, both of Canada

[73] Assignee: Toronto Electric Commissioners, Toronto, Canada; a part interest

[21] Appl. No.: 393,645

[22] Filed: Feb. 24, 1995

[51] Int. Cl.[6] ..... H01R 4/30

[52] U.S. Cl. ..... 439/801; 439/287

[58] Field of Search ..... 439/284, 287, 439/288, 290, 801, 807; 174/845

[56] References Cited

U.S. PATENT DOCUMENTS

| | | | |
|---|---|---|---|
| 1,218,216 | 3/1917 | Schmid . | |
| 1,237,857 | 8/1917 | Averill | 439/284 |
| 1,688,640 | 4/1928 | Levin . | |
| 1,975,244 | 10/1934 | Wiseman . | |
| 2,950,456 | 8/1960 | Rehder | 174/71 B |

FOREIGN PATENT DOCUMENTS

| | | | |
|---|---|---|---|
| 1580489 | 9/1969 | France | 439/801 |
| 472788 | 6/1969 | Switzerland | 439/801 |

*Primary Examiner*—Gary F. Paumen
*Assistant Examiner*—T. C. Patel
*Attorney, Agent, or Firm*—Ridout & Maybee

[57] ABSTRACT

A connector system is provided for connecting conductors of high tension cables during splicing between cables. Each connector comprises lugs having ferrule portions which are crimped to the ends of conductors to be joined and part cylindrical lug portions which are bolted together through filler or connector plates to form a smoothly contoured connection free from edges or projections providing high electrical stress concentrations. The connector plates enable two connections to be joined in parallel to provide branch connections: a smoothly contoured lug adaptor replaces a fourth lug if only a single branch connection is to be made. Smoothly contoured and recessed nuts and bolt head covers contribute to the smooth external contour of the connection.

5 Claims, 2 Drawing Sheets

CONNECTOR FOR USE IN CABLE SPLICES

FIELD OF THE INVENTION

This invention relates to connectors for connecting the conductors of high tension cables in the course of making splices between two or more lengths of cable, particularly underground high tension cables.

REVIEW OF THE ART

High voltage underground cables are widely utilized for electrical distribution in urban areas. Typically such cables are three-phase cables having three conductors, which may be of segmental form, appropriately sheathed and insulated. Typically, the conductors of such cables have been connected by means of sleeves soldered and/or crimped to the conductor ends, the joint being built up with molten lead so as to provide a smooth outer surface. Such a smooth surface is needed to avoid high electrical stress concentrations which might lead to electrical breakdown of the splice in which the connector is incorporated. Such connections are required not only for end to end connection of cables, but also where branch cables are to be attached to a primary distribution cable, which has in the past been achieved by binding branch cable conductors to the sleeves before applying the molten lead.

Since access to the cable is typically constricted in underground vaults and/or cable chambers, improvements upon the traditional method of forming splices, involving as it does the use of molten lead, and the application of considerable heat to cables whose insulation may contain polychlorinated biphenyls, have long been desired. It would be desirable to substitute some means of forming the connections by cold splicing, which reduces or eliminates the application of excessive heat to the cable, and which can fairly readily be implemented in a confined space.

A typical splice involves both the electrical and mechanical connection of conductors in the cable, end to end and possibly with one or two branch cables, and the formation of insulation and sheathing of suitable integrity around the connected conductors. The present invention is concerned solely with the connection of the conductors, and the formation of the insulation and sheathing will not be discussed further.

Crimped connectors for the conductors have been proposed, but have the disadvantage that, as successive conductors in a cable are joined, manipulation of the remaining conductors and associated connectors becomes increasingly more difficult due to mechanical constraints supplied by the conductors which have already been connected. Additionally, such connections, once made, cannot in general be modified subsequently to allow the addition of branch conductors, nor even to separate the conductors without destroying the connection. Moreover, if destruction of the connection leaves the cable ends in a condition in which they cannot be reused, major problems may arise if a sufficient free length of conductor is not available to remake the connection.

Bolt-together connections have been proposed, in which ferrules are crimped onto cable ends, and provided with mating parts which can be secured together to complete a connection. Such an arrangement, while potentially overcoming some of the problems outlined above, does not allow for the making of branch connections, particularly subsequent to the initial construction of the connection. Examples of such connections can be found in U.S. Pat. Nos. 1,218,216 (Schmid), 1,688,640 (Levin) and 1,975,244 (Wiseman).

SUMMARY OF THE INVENTION

The present applicants have developed a bolt-together connector, the major components of which can be crimped to conductors to be connected, and which is designed to provide a connection which avoids excessive electrical stresses, and can accommodate up to two branch cables, which may be installed either at the time of original making of the connection, or subsequently.

Further features of the invention will be apparent from the following description with reference to the accompanying drawings.

SHORT DESCRIPTION OF THE DRAWINGS

DESCRIPTION OF THE PREFERRED EMBODIMENTS

Figure 3:
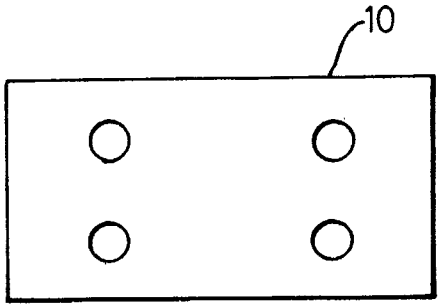
FIGS. 2 and 3 are plan views respectively of a filler plate and a connector plate used alternatively according to whether an end to end or a branch connection is to be made.
Figure 1A:
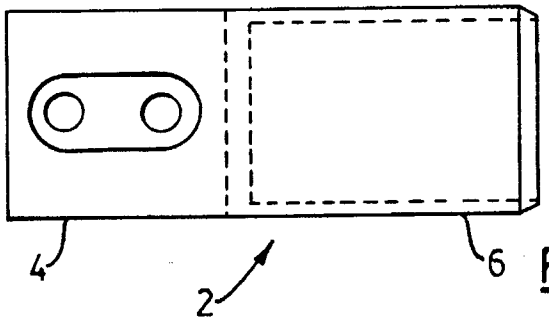
FIGS. 1A and 1B are plan and elevational views respectively of a lug member for crimping to the end of a cable conductor.
Figure 1B:
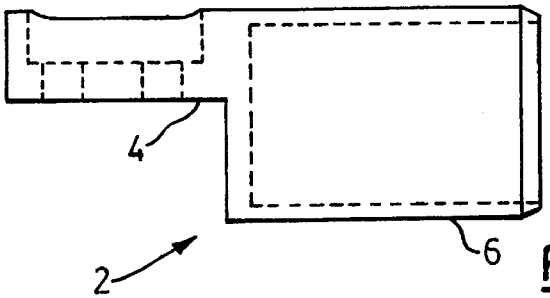
Figure 2:
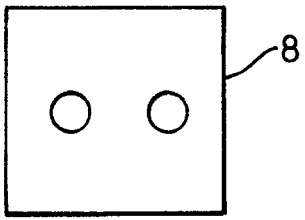

The principal components of the connector of the invention are copper lug members 2 as shown in FIGS. 1A and 1B, together with a copper filler plate 8 as shown in FIG. 2 or a copper connector plate 10 as shown in FIG. 3. While copper will normally be utilized, other suitable conductive metals or alloys could be used.

Figure 4A:
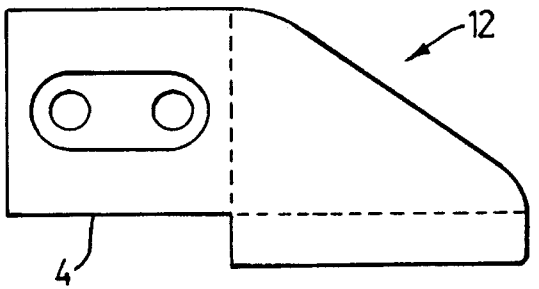
FIGS. 4A, 4B and 4C show plan and side and end elevational views of a lug adaptor.
Figure 4B:
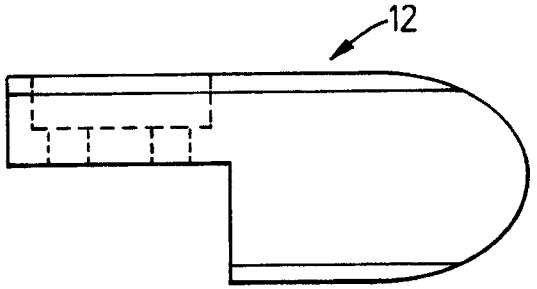
Figure 4C:
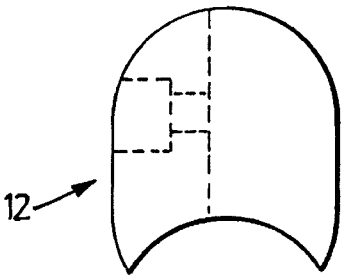
Figure 6:
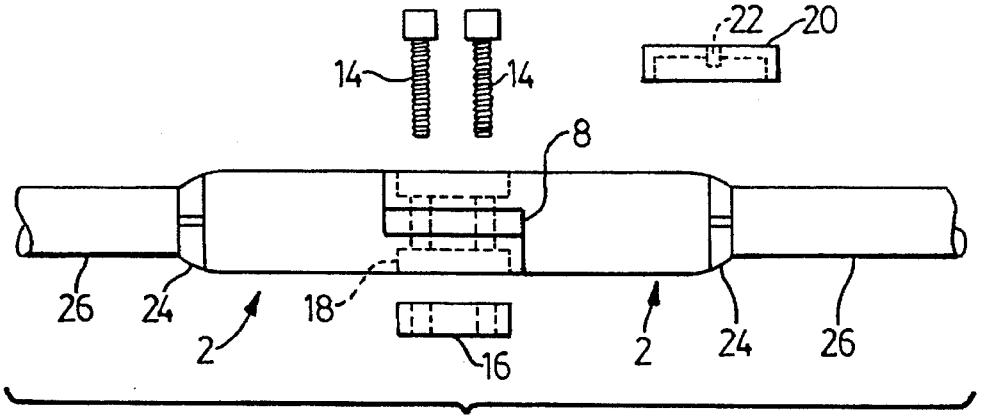
FIG. 6 is a partially exploded view illustrating an end-on connection between two cable ends.
Figure 7:
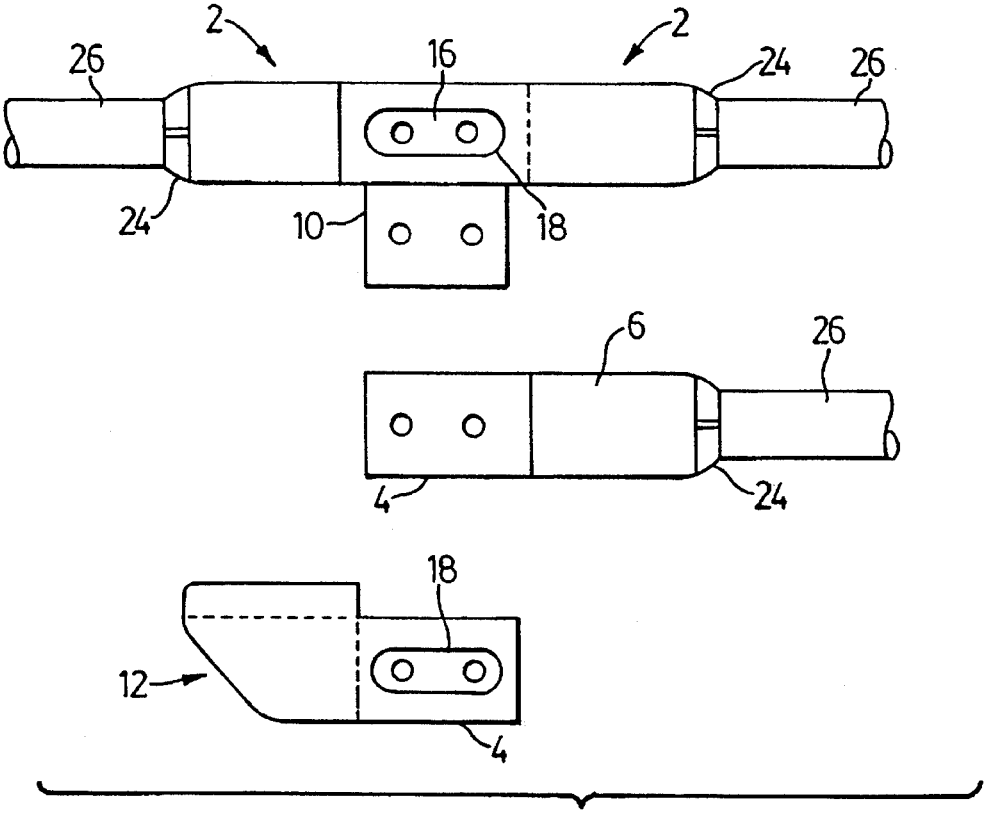
FIG. 7 is a partially exploded view illustrating the connection of a branch conductor.

Each lug 2 consists of a lug portion 4 and a tubular ferrule portion 6. The lug portions 4 are of somewhat less than semi-circular cross-section, so as to accommodate between them a filler plate 8 as shown in FIGS. 2 and 6, or a connector plate as shown in FIGS. 3 and 7, the latter being used when branch connections are to be made. If two branch connections are to be made, a further pair of lugs as shown in FIGS. 1A and 1B is disposed parallel to the first pair, the two being linked by the connector plate 10. If only one branch connection is to be made, one of the lugs is replaced by a lug adaptor 12 as shown in FIG. 4, which provides a smooth contour to the branch connection when its lug portion 4 is bolted through the connector plate 10 to the lug portion 4 of a branch lug (see FIG. 7). The smooth contour of the adaptor 12 reduces electrical stress. In each case the filler or connector plate is fully sandwiched between the lug portions.

Figure 5:
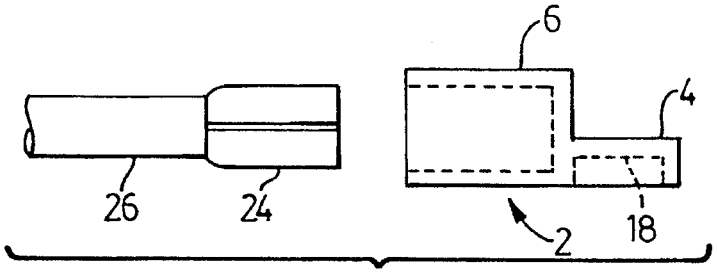
FIG. 5 illustrates assembly of a cable conductor and to a lug.

In order to reduce electrical stress still further, the bolts 14 (see FIG. 6) which are utilized to secure the lugs to the plates, engage in a special twin nut 16 as best seen in FIGS. 6 and 7, which nut is a snug fit in a recess 18 in the lug as shown in FIGS. 5, 6 and 7. The heads of the bolts 14 are housed in a corresponding recess 18 in the other lug portion to be connected, and are covered by a press-on bolt cover 20 as seen in FIG. 6. The bolt cover 20 of FIG. 6 is tapped with a threaded hole 22 so that a screw may be inserted to provide a means for removing the cover if it is desired to dissemble the connection. While two bolts are used in the embodiment shown, a single bolt may suffice in some cases.

If a simple end-to-end connection is made using a filler plate 8 as shown in FIG. 2, the connection may readily be dissembled so as to substitute a connector plate 10 as shown in FIG. 3 should it subsequently be desired to add a branch connection as shown in FIG. 7.

The ferrule 6 of a lug 2 is usually not applied directly to the end of a cable conductor. These conductors, which are multi-stranded, are typically of sector configuration, and to ensure a good connection on a fresh cable end, a split cylindrical sleeve 24 similar to one-half of a sleeve such as is typically utilized in conventional soldered connectors, is compressed onto the end of conductor 26 to provide a suitable cylindrical termination for insertion into the ferrule 6. If a connector in accordance with the invention is being utilized to replace an existing joint, there will usually be a portion of a sleeve already in place on the cable end as a residue of the previous connection, after severing of the connection and removal of any excess lead. The ferrule 6 of the lug 2 is crimped onto the sleeve 26 to form a mechanically and electrically secure connection to the cable, and its blind end adjacent the lug portion 4 provides a barrier against the migration of oil out of the conductor. Lugs can be applied to all of the conductor ends prior to forming any connections, thus greatly simplifying the application process. Thereafter, the lugs 2 are appropriately aligned and connected by the application of bolts 14 passed through bores in the lugs and filler or connector plate, using the filler or connector plates 8 or 10 as appropriate.

The nuts and bolts utilized and any associated washers should be selected so that they will not loosen in service. In order to obtain good control over the torque applied to the bolts, the use of some form of torque wrench is desirable. Conveniently, this may take the form of a hexagon key engaging sockets in the bolt heads, the key being designed so that its end fractures or twists when the desired torque has been achieved.

In order to improve the integrity of the connection, capillary channels may be formed in the filler and/or connector plates, either prefilled with solder, or enabling solder to be run into them, so as to produce a very solid connection. Such a connection can be achieved with very much less heat than would be required for a conventional splice. Additionally, the mating surfaces of the lug portions 4 of the lugs 2 and of the filler and connector plates 8 and 10 may be configured with ridges or grooves to improve the connection between them.

Although the lug portions of the lugs have been described as being connected by bolts, other forms of connection could be used, provided that the requirement for a smooth contour of the finished connection, and sufficient mechanical and electrical integrity, can be achieved.

We claim:

1. A connector for connecting m multi-stranded conductors during splicing of high tension electrical cables, where m is an integer from 2 and 4, comprising n conductive lugs, where n is an even integer from 2 and 4 and at least equal to m, each of the lugs having a part cylindrical lug portion, and m of the lugs having a hollow cylindrical ferrule portion concentric with the part cylindrical lug portions for crimping around ends of the m multi-stranded conductors; a conductive plate entirely sandwiched between said part cylindrical lug portions to form one of a full cylinder and two parallel cylinders; and securing means recessed within each cylinder for mechanically connecting paired lug portions through the conductive plate to provide a connector with a smooth external contour free of edges or projections causing high electrical stress concentrations.

2. A connector according to claim 1, further including a split conductive sleeve for application to each cable end to adapt the latter to the hollow ferrule portion of the associated lug.

3. A connector according to claim 1, for connecting three multi-stranded conductors, wherein three lugs have hollow cylindrical ferrules and a fourth lug includes a smoothly contoured end portion instead of a ferrule portion.

4. A connector according to claim 1, wherein the securing means comprises at least one bolt through each pair of lug portions and the conductive plate.

5. A connector according to claim 4, wherein each bolt has a nut and a head cover flush with the external contour of the connector.

* * * * *